US005087034A

United States Patent [19]

Solis

[11] Patent Number: 5,087,034

[45] Date of Patent: Feb. 11, 1992

[54] ILLUMINATED JUMP ROPE

[76] Inventor: Kenneth M. Solis, 4700 W. Grange Ave., Greenfield, Wis. 53220

[21] Appl. No.: 645,105

[22] Filed: Jan. 24, 1991

[51] Int. Cl.[5] ..... A63B 5/20

[52] U.S. Cl. ..... 272/75

[58] Field of Search ..... 272/74, 75; 273/DIG. 24; 446/219, 243; 40/546; 362/34

[56] References Cited

U.S. PATENT DOCUMENTS

| | | | |
|---|---|---|---|
| 3,539,794 | 11/1970 | Rauhut et al. | 273/DIG. 24 X |
| 3,597,363 | 8/1971 | Avella | 273/DIG. 24 X |
| 4,254,575 | 3/1981 | Gould | 446/219 X |
| 4,529,193 | 7/1985 | Kuhnsman | 272/75 |
| 4,715,564 | 12/1987 | Kinn et al. | 446/219 X |
| 4,717,158 | 1/1988 | Pennisi | 273/DIG. 24 X |
| 4,776,585 | 10/1988 | Maleyko et al. | 272/75 |
| 4,963,117 | 10/1990 | Gualdoni | 446/219 |

FOREIGN PATENT DOCUMENTS

| | | | |
|---|---|---|---|
| 2276069 | 1/1976 | France | 272/75 |

*Primary Examiner*—Richard J. Apley
*Assistant Examiner*—L. Thomas
*Attorney, Agent, or Firm*—Andrus, Sceales, Starke et al.

[57] ABSTRACT

A jump rope is made of a hollow translucent, flexible plastic tube and includes a plurality of light sticks inserted in the tube and spaced along the length of the jump rope for providing a jump rope which glows when the light sticks are activated. The light sticks may be readily removed and replaced when they are expended.

11 Claims, 1 Drawing Sheet

FIG. 1
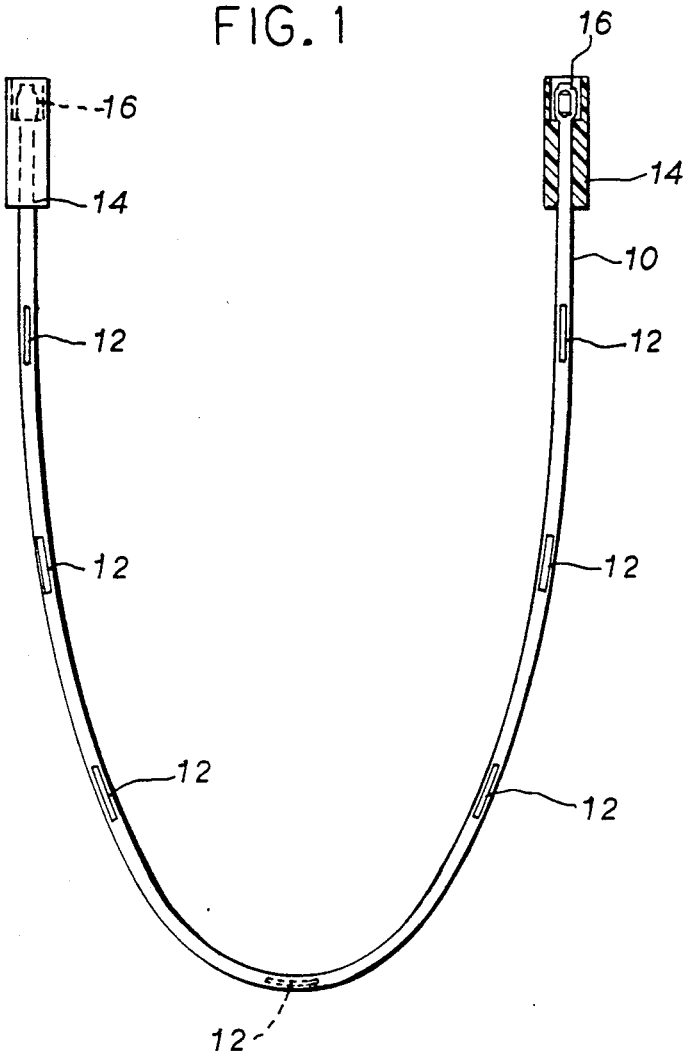
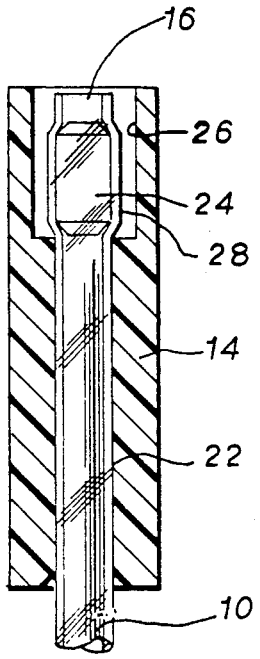
FIG. 3
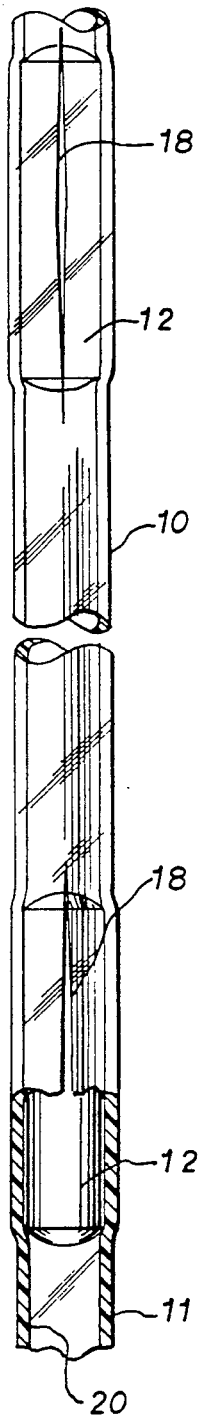
FIG. 2

ILLUMINATED JUMP ROPE

BACKGROUND OF THE INVENTION

1. Field of the Invention

The invention is generally related to jump ropes and more particularly is related to an illuminated jump rope including light sticks.

2. Description of the Prior Art

Jump ropes have been popular as toys for generations. They not only provide fascination for children but also may be used to enhance aerobic exercise routines.

To further enhance the enjoyment of the jump rope, particularly with respect to small children, there have been a number of attempts to provide illuminated jump ropes which create the illusion of moving arcs of light, particularly when used in the dark. Examples of illuminated jump ropes are shown in U.S. Pat. Nos. 4,776,585 issued to Maleyko et al, and 4,529,193 issued to Kuhnsman. The Maleyko patent discloses a jump rope having light sources such as light emitting diodes spaced along a translucent tube and connected to a battery source contained within the jump rope handle. The Kuhnsman patent also includes an electrical power source contained in the jump rope handle, but uses light bulbs such as flashlight bulbs in the handles and includes fiber optic strands housed within a translucent tube for transmitting the light from the bulbs throughout the length of the tube.

The illuminated jump ropes of the prior art have several disadvantages related to the use of electrical circuitry and power sources in order to provide the desired illuminated effect. The somewhat delicate electrical circuitry can be broken or rendered nonfunctional through the rigorous normal use of the jump rope. In addition, such jump ropes are toys which, to the disdain of parents, include replaceable batteries which small children habitually remove and misplace. Also, such jump ropes require a number of manufacturing steps making them substantially more expensive than standard non-illuminated jump ropes.

A number of years ago light sticks became available such as those disclosed in U.S. Pat. Nos. 3,597,363 and 3,539,794 assigned to American Cyanamid Corporation, One Cyanamid Plaza, Wayne, N.J. 07470. The light sticks provide a glowing illumination through chemical action caused by releasing a chemical reaction through flexing of the stick. Such sticks have been incorporated in toys and novelty items such as, by way of example, the game footbag disclosed in U.S. Pat. No. 4,717,158 issued to Pennisi. As there shown, a game footbag includes a receptacle for receiving an American Cyanamid type light stick, whereby the light stick creates a soft glowing light once activated by kicking the footbag.

SUMMARY OF THE INVENTION

The illuminated jump rope of the subject invention includes a plurality of miniature light sticks inserted into the hollow interior of a translucent, flexible tube. When the light stick is flexed to release the chemical reaction and then placed in motion through the normal activity of turning the jump rope, the action produces an illuminated, glowing jump rope. The light sticks may be inserted into the tubing through slits in the outer wall of the tubing and are held in place by the frictional and compressional forces of the tubing against the perimeter of the light sticks. When the sticks stop glowing, they may be easily replaced with new light sticks by removing and replacing them through the slit. Where desired, a plurality of light sticks of different colors may be included in the jump rope to provide different visual effects. The frictional force holding the light sticks in the tube is sufficient to hold the stick in place during normal jumping activity, while permitting an adult to readily remove the light sticks from the tube by flexing the tube and forcing the light stick through the slit.

It is an object and feature of the present invention to provide an illuminated jump rope which is simple and inexpensive to manufacture and does not include any electrical circuitry which is subject to breakage and malfunction.

It is another object and feature of the invention to provide an illuminated jump rope with light sticks which may be readily replaced by the consumer when worn out, with the consumer having the option of utilizing light sticks of a variety of colors to create different visual effects.

Other objects and features of the invention will be readily apparent from the enclosed drawing and detailed description of the preferred embodiment.

BRIEF DESCRIPTION OF THE DRAWINGS

FIG. 1 is an elevational view of a jump rope in accordance with the present invention.

FIG. 2 is an enlarged view of a section of the jump rope, partially in section, showing the placement of light sticks in the interior of the tube.

FIG. 3 is an enlarged view of a section of the jump rope, partially in section, showing the handle and tube assembly.

DETAILED DESCRIPTION OF THE PREFERRED EMBODIMENT

As shown in FIG. 1, the jump rope of the subject invention includes a translucent, flexible tube 10 such as, by way of example, an extruded plastic tube 11 having a through hollow core. A plurality of discrete light emitting elements, such as light sticks 12 are inserted in the tube and spaced along its length. The light sticks may be of any known manufacturer, such as, by way of example, the miniature CYALUME brand of light sticks manufactured by American Cyanamid Corporation. A handle 14 is attached to the opposite outer ends 16 of the jump rope to provide the finished toy.

The light sticks may be inserted in the tube in any desired manner. However, it has been found particularly advantageous to provide a plurality of slits 18 (FIG. 2) in the outer wall of the tube 10, through which the light sticks 12 may be inserted. In the preferred embodiment, the inside wall 20 of the tube 10 defines an inside diameter of approximately $\frac{3}{8}$ inch which is slightly smaller than the outer diameter of the miniature CYALUME light stick 12. Thus, when the light stick is inserted through the slit 18 and into the tube, the frictional and compressive forces between the tube and the light stick hold the light stick securely in place even during vigorous movement of the jump rope. Depending on the force desired to remove the light stick from the tube, the slit 18 may be slightly larger than, equal to or slightly smaller than the length of the light stick 12. For example, if a greater force is required, this can be accomplished by making the slit 18 slightly smaller than the length of the light stick, requiring substantial flexing of the tube in order to remove the light stick therefrom. Where less force is desired, this can be achieved by making the slit slightly larger than the length of the light stick.

As shown in FIG. 3, the jump rope handle 14 of the preferred embodiment includes a hollow spool having a through cylindrical hollow core 22 which is slightly larger than the outer diameter of the tube 10. An open outer end 16 of the tube may be inserted in the hollow core 22, as shown. A retainer plug 24 may then be inserted in the open outer end 16 of the tube to expand the outer diameter of the tube to a size larger than the inner diameter of the core 22, effectively retaining the handle 14 on the jump rope. As shown, it is desirable to include an enlarged recess 26 on the outer end of the handle 14 for receiving and housing the enlarged end 28 of the tube 10, which results from the insertion of the plug 24.

While certain features and embodiments of the invention have been described in detail herein, it will be readily understood that the invention encompasses all enhancements and modifications within the scope and spirit of the following claims.

What is claimed is:

1. A jump rope, comprising:

a. a hollow, elongated, flexible, translucent tube of sufficient length to be used for jumping, said tube having an outer wall and an inner wall and open outer ends;

b. a plurality of discrete light emitting elements of a predetermined length and having opposite outer ends and an outer periphery which is slightly larger than the inner diameter of the tube, the light emitting elements inserted in the tube and spaced along its length, and held in place by friction between the inner wall of the tube and the periphery of the light emitting element, the tube further including through slits communicating the outer wall of the tube of the hollow interior, each of said slits of approximately the same length as one of the light emitting elements, whereby light emitting element may be inserted in and removed from the tube through the slits; and c. handles, one each attached to the outer ends of the tube.

2. The jump rope of claim 1, wherein the light emitting elements are each of a predetermined length and have opposite outer ends and wherein the tube includes through slits communicating the outer wall of the tube with the hollow interior, each of said slits of approximately the same length as one of said light emitting elements, whereby a light emitting element may be inserted in and removed from the tube through the slit.

3. The jump rope of claim 2, wherein said slits are longer than said light emitting elements.

4. The jump rope of claim 2, wherein said slits are shorter than said light emitting elements.

5. The jump rope of claim 1, wherein the tube comprises an extruded, transparent, plastic material having an inside diameter of approximately ⅜ inch.

6. The jump rope of claim 1, wherein each of said handles further includes a spool having a hollow cylindrical core with open ends, said core having an inside diameter larger than the outside diameter of the tube, and wherein there is further included a cylindrical retainer plug having an outer diameter slightly larger than the inside diameter of the tube, wherein said retainer plug is adapted to be inserted in an open outer end of the tube to expand the outside diameter thereof for retaining a handle thereon.

7. The jump rope of claim 6, wherein each of said handles includes an enlarged recess in one end of and coaxial with the core for receiving the enlarged outer end of the tube resulting from the insertion of said retainer plug.

8. The jump rope of claim 1, wherein the plurality of discrete light emitting elements are of different colors.

9. A jump rope comprising:

a. a hollow, elongated, flexible, translucent tube of sufficient length to be used for jumping, said tube having an outer wall and including a plurality of predetermined slits spaced along its length, each slit of predetermined length and communicating the outer wall of the tube with the hollow interior;

b. a plurality of light sticks each having an outer periphery which is slightly larger than the inner diameter of the tube, each of said light sticks of a predetermined length and adapted to be received by and inserted in and removed from the tube through said slits, whereby the light stick is retained in the tube by the friction between the inside wall of the tube and outer periphery of the light stick;

c. a pair of handles, each including a spool having a hollow cylindrical core with open ends, said core having an inside diameter larger than the outside diameter of the tube, whereby said handle may be placed on an open outer end of the tube and the tube may be received by said core; and d. a retainer plug having an outer diameter slightly larger than the inner diameter of the tube and adapted to be inserted in an open outer end of the tube for expanding the outside diameter thereof for retaining a handle on the tube.

10. The jump rope of claim 9, wherein each of said handles includes an enlarged recess in one end and coaxial with the core for receiving the enlarged outer end of the tube resulting from the insertion of the retainer plug.

11. The jump rope of claim 9, wherein the tube comprises an extruded, transparent, plastic material having an inside diameter of approximately ⅜ inch.

* * * * *